United States Patent [19]

Asahi et al.

[11] Patent Number: 4,587,694

[45] Date of Patent: May 13, 1986

[54] BOTTOM STOP FOR SLIDE FASTENERS

[75] Inventors: Sadaho Asahi; Hiroo Minami, both of Uozu, Japan

[73] Assignee: Yoshida Kogyo K.K., Tokyo, Japan

[21] Appl. No.: 558,465

[22] Filed: Dec. 6, 1983

[30] Foreign Application Priority Data

Dec. 6, 1982 [JP] Japan ..... 57-184623[U]

[51] Int. Cl.[4] ..... A44B 19/36

[52] U.S. Cl. ..... 24/435; 24/436

[58] Field of Search ..... 24/435, 436

[56] References Cited

U.S. PATENT DOCUMENTS

| | | | |
|---|---|---|---|
| 2,217,571 | 10/1940 | Süsskind | 24/436 |
| 2,312,045 | 2/1943 | Morin | 24/435 |
| 2,474,908 | 7/1949 | Morin | 24/435 |
| 2,483,703 | 10/1949 | Legat | 24/436 |
| 2,988,796 | 6/1961 | Johns | 24/436 |
| 3,864,792 | 2/1975 | Takahashi et al. | 24/435 |
| 4,112,553 | 9/1978 | Weitzner | 24/436 |
| 4,437,210 | 3/1984 | Fukuroi | 24/435 |

FOREIGN PATENT DOCUMENTS 49-37763 10/1974 Japan .

*Primary Examiner*—Francis K. Zugel
*Assistant Examiner*—Peter A. Aschenbrenner
*Attorney, Agent, or Firm*—Hill, Van Santen, Steadman & Simpson

[57] ABSTRACT

A bottom stop with an ornamental design thereon has a pair of upper and lower rectangular plates spaced from each other and integrally joined by a connector post located adjacent to one end of each of the upper and lower plates. The upper plate has a pair of longitudinal side flanges having rows of sawteeth, and the lower plate has rows of sawteeth. The bottom stop can be attached to a slide fastener by inserting stringer tapes between the upper and lower plates with an end of rows of coupling elements held in abutment against the connector post, and then bending lateral portions of the lower plate adjacent to the connector post toward the upper plate until the stringer tapes of the slide fastener are gripped firmly by and between the sawteeth on the upper and lower plates.

2 Claims, 6 Drawing Figures

BOTTOM STOP FOR SLIDE FASTENERS

BACKGROUND OF THE INVENTION

1. Field of the Invention

The present invention relates to a bottom stop for being mounted on a pair of companion slide fastener stringers across a bottom end of a pair of intermeshing rows of coupling elements and having a surface for bearing an ornamental pattern.

2. Prior Art

Ornamental bottom stops for slide fasteners have longer and wider dimensions to provide a surface large enough to bear a suitable decorative pattern than those of ordinary slide fastener bottom stops. One known type of such bottom stop is disclosed in Japanese Utility Model Publication No. 49-37763 published on Oct. 16, 1974. The disclosed bottom stop is composed of a fastening member and a stiffening member. The fastening member has a channel-shaped cross section including a plurality of pointed clinching legs for penetrating slide fastener stringer tapes. For attachment, the fastening member is placed on one side of the slide fastener at a bottom end thereof while the stiffening member is placed on the other side in alignment with the fastening member. The fastening member is pressed against the slide fastener until the pointed clinching legs pass through the stringer tapes. Then, the pointed clinching legs are bent into clinching engagement with the stiffening member to hold the fastening and stiffening members firmly together. The ornamental bottom stop is dimensionally larger than normal bottom stops and should be securely attached to the stringer tapes to avoid unwanted positional displacement or unstableness. One proposal would be to provide as many or large pointed clinching legs as possible. However, they would damage and reduce the strength of the stringer tapes to an undesirable extent. Fewer or smaller pointed clinching legs would fail to secure the bottom stop to the tapes with a sufficiently large strength. Another problem is that if the pointed clinching legs were staked on the stiffening member under too a strong force, then the fastening member and the stiffening member would tend to be deformed, resulting in an impaired ornamental design. The prior bottom stop also has had a drawback in that the clinching legs are liable to turn up off the stiffening member while in prolonged use, particularly under rough usage. When this happens, the fastening and stiffening members are likely to be disassembled, and the clinching legs as they project may damage the wearer's clothes and injure the wearer's body.

SUMMARY OF THE INVENTION

It is therefore an object of the present invention to provide a bottom stop having an ornamental pattern which can be attached firmly and easily to slide fastener stringer tapes and remain attached to the stringer tapes securely for a long period of time.

According to the present invention, a bottom stop for a slide fastener has a pair of upper and lower rectangular plates spaced from each other and integrally joined by a connector post located adjacent to one end of each of the upper and lower plates, the upper plate bearing an ornamental design thereon. The upper plate has a pair of longitudinal side flanges having respective rows of sawteeth, and the lower plate has respective rows of sawteeth. The bottom stop can be attached to a slide fastener by inserting stringer tapes thereof between the upper and lower plates until an end of rows of coupling elements is brought into abutment against the connector post, and then bending lateral portions of the lower plate adjacent to the connector post toward the upper plate to grip the stringer tapes firmly by and between the sawteeth on the upper and lower plates. The lower plate may have a pair of side flanges on which the respective rows of sawteeths are provided.

Many other advantages and features of the present invention will become manifest to those versed in the art upon making reference to the detailed description and the accompanying sheets of drawings in which preferred structural embodiments incorporating the principles of the present invention are shown by way of illustrative example.

DETAILED DESCRIPTION

Figure 1:
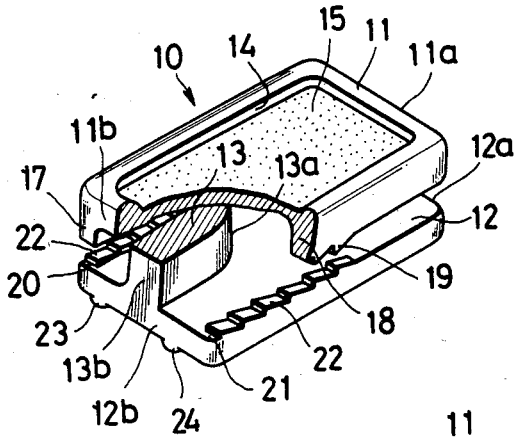
FIG. 1 is a perspective view, partly cut away, of a bottom stop according to the present invention, the view showing the bottom stop as viewed from above.
Figure 2:
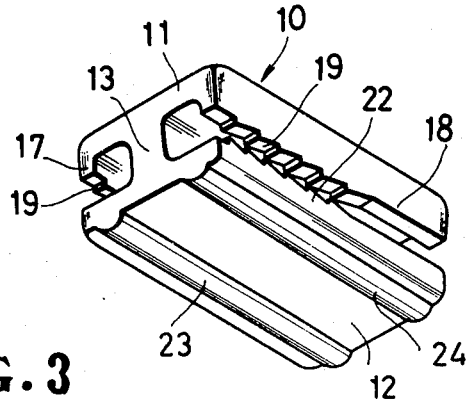
FIG. 2 is a perspective view of the bottom stop which is illustrated as viewed from below.

The principles of the present invention are particularly useful when embodied in a bottom stop, generally designated at 10, as shown in FIGS. 1 and 2.

The bottom stop 10 is basically composed of a pair of rectangular upper and lower plates 11, 12 of substantially the same size. The upper and lower plates 11, 12 are spaced from each other and integrally joined together in parallel relationship by a connector post 13 having a bullet-shaped cross section and positioned transversely centrally of the plates 11, 12. The connector post 13 has a front end 13*a* located remotely from ends 11*a*, 12*a* of the upper and lower plates 11, 12 and a rear end 13*b* lying flush with opposite ends 11*b*, 12*b* of the upper and lower plates 11, 12.

The upper plate 11 has an upper recessed surface 14 having a suitable ornamental design 15. The upper plate 11 includes a pair of longitudinal side flanges 17, 18 extending over the full length of the upper plate 11 and projecting toward the lower plate 12. The side flanges 17, 18 are spaced from each other transversely of the upper plate 11. Each of the side flanges 17, 18 has a row of sawteeth 19 on a lower surface facing the lower plate 12. The row of sawteeth 19 extends longitudinally from the end 11*b* toward the end 11*a* for an interval longer than the connector post 13, but terminates short of the end 11*a*. The lower plate 12 has on each of side edges 20, 21 facing the upper plate 11 a row of sawteeth 22 extending longitudinally from the end 12*b* toward the end 12*a* for an interval longer than the connector post 13 and terminating short of the end 12*a*. The rows of sawteeth 19, 22 have the same, length and the sawteeth 19, 22 are progressively tapered off in height toward the ends 11*a*, 12*a* as better shown in FIG. 5. More specifically, each of the sawteeth 19 has a substantially vertical tooth face directed toward the ends 11*b*, 12*b*, and an inclined tooth back sloping downardly toward the ends 11*a*, 12*a*. Each row of sawteeth 19 has a varying height progressively reducing toward the ends 11*a*, 12*a*.

The lower plate 12 has a pair of transversely spaced ridges 23, 24 of an arcuate cross section disposed one on each side of the connector post 13 equidistantly therefrom and extending longitudinally over the full length of the lower plate 12 on a surface thereof remote from the upper plate 11.

Figure 4:
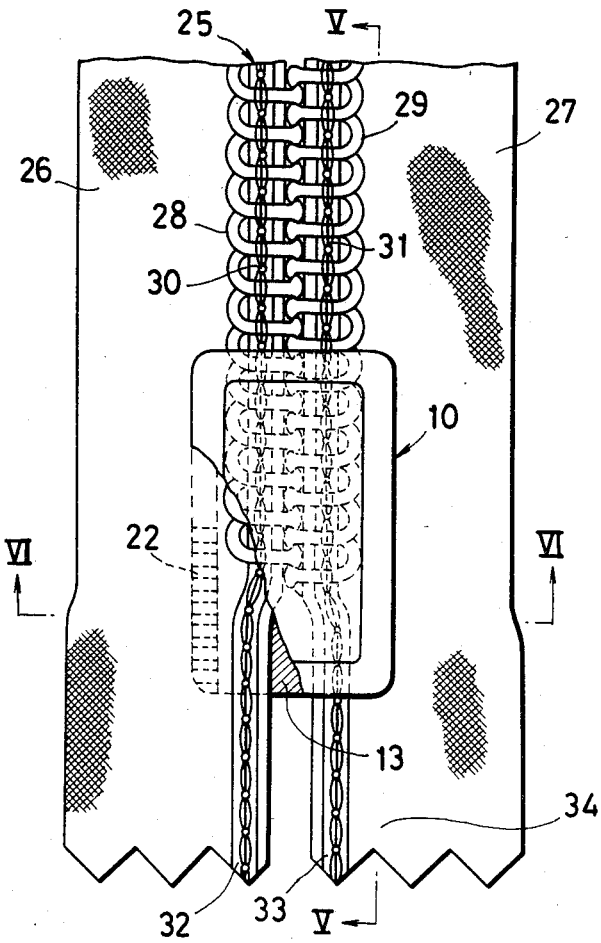
FIG. 4 is a front elevational view, partly broken away, of the bottom stop of FIGS. 1 and 2 attached to a slide fastener.
Figure 5:
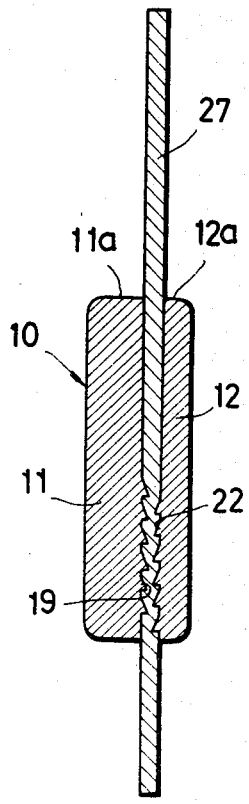
FIG. 5 is a cross-sectional view taken along line V—V of FIG. 4.
Figure 6:
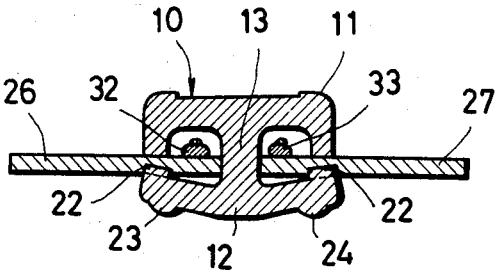
FIG. 6 is a cross-sectional view taken along line VI—VI of FIG. 4.

As shown in FIGS. 4 through 6, a slide fastener 25 to which the bottom stop 10 is to be attached comprises a pair of stringer tapes 26, 27 supporting on their inner longitudinal edges a pair of rows of coupling elements 28, 29 sewn respectively to the inner longitudinal edges of the stringer tapes 26, 27 by sewing threads 30, 31 passing through reinforcing cores 32, 33 inserted through the rows of coupling elements 28, 29, respectively. For attaching the bottom stop 10 to the slide fastener 25, the bottom stop 10 is brought over the interengaged slide fastener 25 from a lower end 34 thereof, with the ends 11*a*, 12*a* ahead, by inserting the stringer tapes 26, 27 between the upper and lower plates 11, 12 until the connector post, 13 is held against a lower-most coupling element 29 with the stitched reinforcing cores 32, 33 positioned one on each side of the connector post 13. Since the sawteeth 19, 22 are progressively tapered off toward the ends 11*a*, 12*a*, the stringer tapes 26, 27 can easily be inserted between the upper and lower plates 11, 12. Then, the upper and lower plates 11, 12 are staked or pressed into gripping engagement with the stringer tapes 26, 27 by appropriate means such as a press. Any pressing force applied to the lower plate 12 is imposed through the ridges 23, 24 which are in contact with the pressing member (not shown). The central portion of the lower plate 12 which is located directly below the connector post 13 is prevented by the latter from being deformed, and the lateral side portions of the lower plate 12 are obliquely deformed in response to the applied pressing force toward the upper plate 11 as shown in FIG. 6 until the ridges 23, 24 lie flush with the central portion of the lower plate 12 with a result that the sawteeth 19, 22 on the upper and lower plates 11, 12 are forced into biting engagement with the stringer tapes 26, 27. Since the lateral sides of the lower plate 12 adjacent to the connector post 13 are obliquely bent toward the upper plate 11, the sawteeth 22 on the lower plate 12 bite the stringer tapes 26, 27 at an angle, thus holding the stringer tapes 26, 27 securely in place. With the sawteeth 19, 22 tapered off toward the ends 11*a*, 12*a*, the bottom stop 10 can be held in position against the pulling force applied thereto by operator's fingers in a direction away from the ends 11*a*, 12*a* when a slide fastener is closed. The oblique plastic deformation of the lower plate 12 enables the latter to remain staked without the tendency to resiliently restore its original shape during a long period of use. The portion of the lower plate 12 between the front end 13*a* of the connector post 13 and the end 12*a* of the lower plate 12 is pressed toward the upper plate 11 in parallel relationship with the stringer tapes 26, 27 and with the coupling elements 28, 29 sandwiched therebetween.

The press for staking the bottom stop 10 in place on the slide fastener 25 should have a die for backing the upper plate 11 and a punch for pressing the lower plate 12 toward the upper plate 11, the die and the punch having flat confronting surfaces. The bottom stop 10 can therefore be attached simply by the press to the slide fastener 25 without piercing or otherwise damaging the stringer tapes 26, 27, and hence without reducing the mechanical strength of the slide fastener 25. The upper plate 11 is undeformed during the pressing operation, so that the ornamental pattern 15 thereon is free from any damage. Accordingly, the bottom stop 10 remains highly effective in providing a desired decorative effect after it has been attached to the slide fastener 25.

Figure 3:
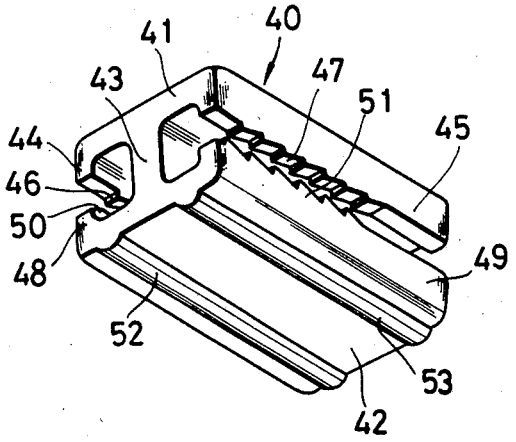
FIG. 3 is a perspective view of a bottom stop according to a modification.

FIG. 3 illustrates a modified bottom stop 40 comprising upper and lower rectangular plates 41, 42 spaced from each other in parallel relationship and integrally joined by a connector post 43. The upper plate 41 has a pair of longitudinal side flanges 44, 45 projecting toward the lower plate 42 and having respective rows of sawteeth 46, 47, and the lower plate 42 also has a pair of longitudinal side flanges 48, 49 projecting toward the upper plate 41 and having respective rows of sawteeth 50, 51 aligned with the rows of sawteeth 46, 47, respectively. The lower plate 42 also has a pair of longitudinal ridges 52, 53 on a surface thereof remote from the upper plate 41 and spaced transversely from each other. With the arrangement shown in FIG. 3, the sawteeth 50, 51 are spaced from the sawteeth 46, 47 by a distance smaller than that between the sawteeth 19 and the sawteeth 22 of the bottom stop 10 shown in FIGS. 1 and 2. This allows the bottom plate 42 to be deformed to a smaller extent in gripping the stringer tapes between the sawteeth 46, 47 and the sawteeth 50, 51.

Although various minor modifications may be suggested by those versed in the art, it should be understood that we wish to embody within the scope of the patent warranted hereon, all such embodiments as reasonably and properly come within the scope of our contribution to the art.

What is claimed is:

1. A slide fastener bottom stop for attachment to a pair of stringer tapes thereof having coupling elements, (a) a pair of first and second elongate plates spaced from each other in parallel relationship and receptive of the tapes therebetween, said first and second plates having longitudinally opposite ends;

(b) a connector post interconnecting said first and second plates at a transversely central position, said connector post having one end terminating short of one of said longitudinally opposite ends of each plate, and another end lying flush with the other opposite end of each plate, said one connector post end being abuttable by the endmost one of the interengaged coupling elements;

(c) said first and second plates each having longitudinal rows of sawteeth along longitudinal edges thereof facing each other, each of said sawteeth having a tooth face directed toward said other opposite end and a tooth back sloping downwardly toward said one of the opposite ends, each said row of sawteeth having a varying height progressively reducing toward said one opposite end; and (d) one of said first and second plates having a pair of laterally spaced straight ridges disposed on a surface thereof remote from said sawteeth, one on each side of said connector post equidistantly therefrom, and extending longitudinally of said plate.

2. A slide fastener bottom stop for attachment to a pair of stringer tapes thereof having coupling elements, comprising:

(a) a pair of first and second elongate plates spaced from each other in parallel relationship and receptive of the tapes therebetween;

(b) a connector post interconnecting said first and second plates at a transversely central position;

(c) said first and second plates each having longitudinal rows of sawteeth along longitudinal edges thereof facing each other;

(d) one of said first and second plates having a pair of laterally spaced straight ridges disposed on a surface thereof remote from said sawteeth, one on each side of said connector post equidistantly therefrom, and extending longitudinally of said plate, for concentrating a compressive clinching force on the marginal edges of said first plate remotely from said connector post; and (e) said first and second plates having exposed longitudinally opposite ends, said connector post having one end extending less than half the distance to one of said longitudinally opposite ends of each plate and another end lying flush with the other exposed opposite end of each plate, said one connector post end being abuttable by the endmost one of the interengaged coupling elements.

* * * * *